United States Patent [19]

Hoehn

[11] 4,206,671

[45] Jun. 10, 1980

[54] IMPELLER FOR USE WITH VEGETABLE CUTTER

[76] Inventor: Vaughn E. Hoehn, P.O. Box 1334, Richland, Wash. 99352

[21] Appl. No.: 941,316

[22] Filed: Sep. 11, 1978

[51] Int. Cl.[2] ..... B26D 7/06

[52] U.S. Cl. ..... 83/408; 83/403; 83/411 R; 83/733; 198/676

[58] Field of Search ..... 198/661, 676; 83/402, 83/403, 404.3, 408, 411 R, 733

[56] References Cited

U.S. PATENT DOCUMENTS

| | | | |
|---|---|---|---|
| 2,934,117 | 4/1960 | Urschel et al. | 83/403 X |
| 3,857,310 | 12/1974 | Tiby | 83/403 |

*Primary Examiner*—J. M. Meister

*Attorney, Agent, or Firm*—Christensen, O'Connor, Johnson & Kindness

[57] ABSTRACT

An improved impeller assembly for use in a vegetable cutter comprises a series of equally spaced impeller blades radiating from a central shaft. The blades of the impeller curve around the shaft as they extend along the shaft to form curved, cupped sections of the blade. The impeller assembly rotates within a hollow drum and the blades urge vegetables within the drum against a slabbing knife having its cutting edge positioned within the drum. The curve of the impeller blades is such that when vegetables are introduced into the drum, the impeller blades curve away from the vegetables. The force with which the vegetables contact the blades is thus reduced so as to avoid bruising the vegetables. The shape of the impeller blades also serves to properly align the vegetables within the drum prior to slicing. In a preferred embodiment, the interior of the drum has a series of grooves formed therein to assist in aligning the vegetables prior to cutting.

19 Claims, 10 Drawing Figures

Fig. 6.
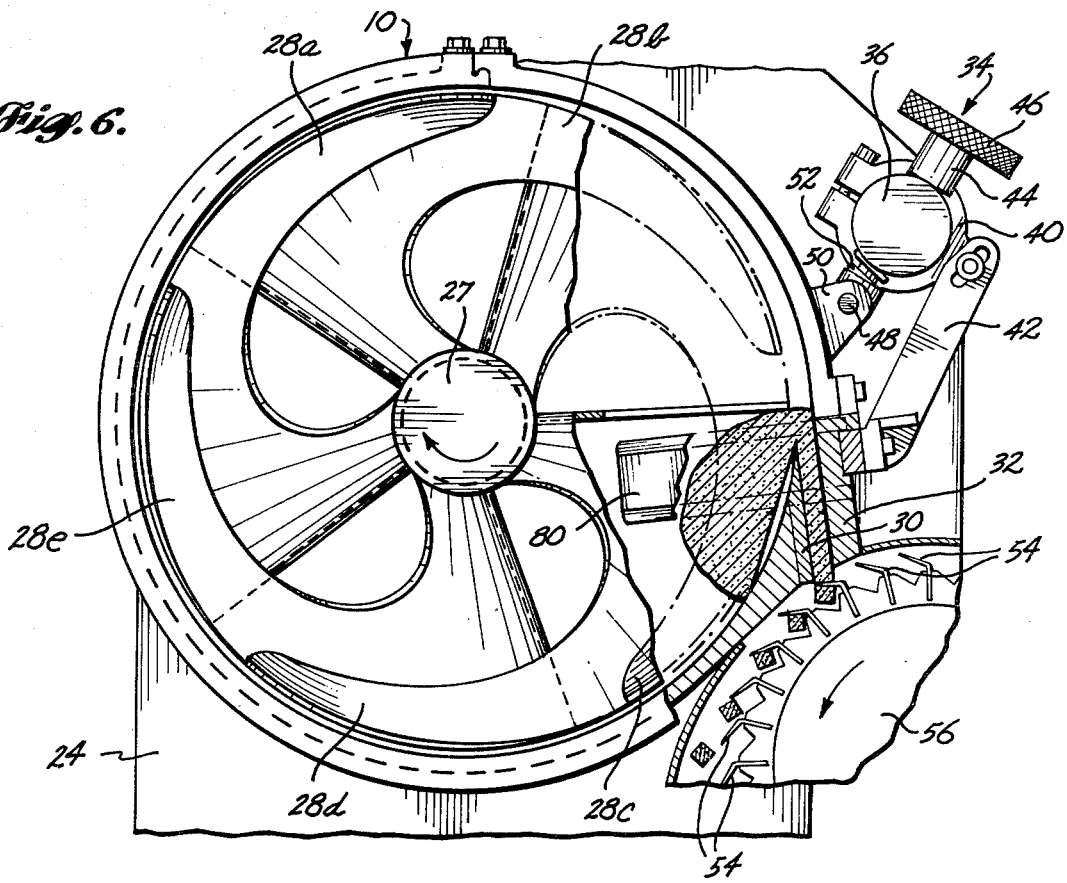
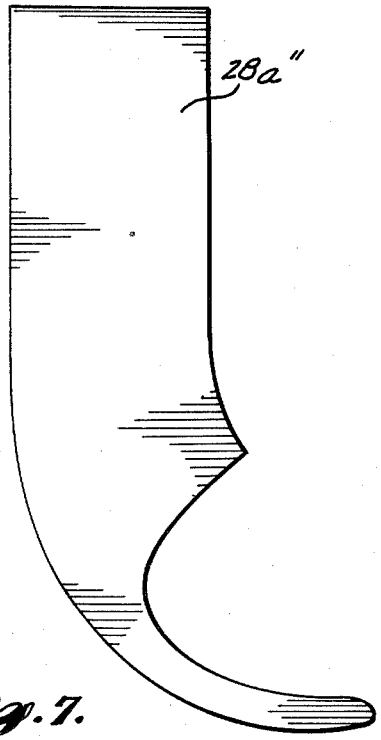
Fig. 7.
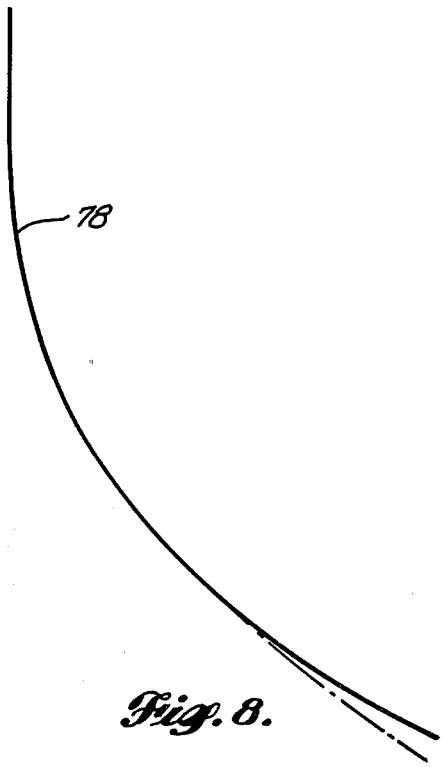
Fig. 8.

IMPELLER FOR USE WITH VEGETABLE CUTTER

BACKGROUND OF THE INVENTION

This invention relates to vegetable cutters and more particularly relates to an improved impeller for use in a vegetable cutter to urge the vegetables being cut against the blade of the cutting knife.

Several vegetable cutting machines are known in the art. One of these is the french fry cutter, Model GRL manufactured by Urschel Laboratories, Valparaiso, Indiana. The Urschel Model GRL french fry cutter has a hollow, substantially cylindrical drum into which the potatoes to be cut are introduced. The drum has a forward open end through which the potatoes pass. An impeller unit mounted within the drum includes a solid backplate which prevents the potatoes from exiting the drum. The back plate is orthogonal to the cylindrical axis of the drum. A series of impeller blades extend from the backplate and are radially oriented within the drum. The blades extend radially inwardly from adjacent the interior surface of the drum a distance less than the radius of the drum but sufficient to engage a potato in the drum. The impeller unit is mounted within the drum for rotational movement of the impeller blades about an axis coincident with the cylindrical axis of the drum such that the impeller blades sweep the interior surface of the drum, pushing any potatoes which are in the drum before them. An elongate slabbing knife is positioned adjacent the drum with its elongate dimension substantially parallel to the axis of the drum. The cutting edge of the knife extends into the drum. As the impeller blades rotate, they push the potatoes around the interior of the drum and into contact with the slabbing knife, causing a slab to be cut from the potatoes. Once the first slab is cut, a series of circumferential grooves formed on the interior surface of the drum hold the potato in place until it is completely cut into slices. Another series of knife blades is preferably positioned outside the drum to cut the slabs emerging from the drum into individual french fries.

The potatoes are introduced into the drum by sliding them down a chute positioned in front of the drum and allowing them to fall into the open end of the drum. Since the cutting operation is continuous, the impeller blades are constantly rotating around the interior surface of the drum as the potatoes are being fed into the drum. Therefore, as the potatoes enter the drum and drop toward the periphery of the drum, they are abruptly hit by the next blade coming by. The abrupt contact of the flat blade against the potatoes can bruise or fracture the potato, resulting in a bruised or fractured french fry. Such fries detract from the quality of the final product and reduce the economic efficiency of the operation.

The majority of the potatoes utilized in the process will be generally oblong in shape, having a major axis which is longer than a minor axis of the potato. It is desirable that the potato be aligned such that the major axis lies along the longitudinal dimension of the impeller blade when it reaches the slabbing knife so that a longer slice will be cut, resulting in longer french fries. In the conventional apparatus now in use, there is a tendency for some of the potatoes to flip as they enter the drum or to bounce off the backplate and align themselves with the major axis radially oriented to the interior surface of the drum such that the cut is made along the minor dimension of the potato and resulting in short french fries. In the french fry industry, a batch of french fries having a high percentage of short, i.e., approximately less than 3", french fries is considered to be of low quality and commands a lower price than french fries in which the majority of the fries are over 3" long.

It is therefore an object of the present invention to provide an improved impeller for use with vegetable cutters which will gently accept the vegetables from the loading chute into the drum without bruising or fracturing the vegetables.

It is a further object of the invention to provide an improved impeller blade which when used in a french fry cutter will in nearly all cases align the potato so that it is presented to the cutting blade with its longest dimension substantially parallel to the cutting knife to provide a high percentage of long french fries.

It is yet another object of this invention to provide an improved impeller which will permit the vegetable cutter to provide a high quality output product while accepting input raw material at a higher rate than prior art impellers.

SUMMARY OF THE INVENTION

A vegetable cutter comprises a hollow, substantially cylindrical drum for receiving vegetables, the drum having a forward end through which the vegetables are introduced and a rear end. A slabbing knife is mounted adjacent the periphery of the drum, the knife being oriented parallel to the cylindrical axis of the drum, extending into the interior of the drum and terminating in a cutting edge. A plurality of impeller blades are mounted within the drum for movement of the blades such that the blades sweep the interior surface of the drum so as to urge the vegetables within the drum against the cutting edge of the knife. In accordance with the foregoing objects, an improved impeller is provided in the vegetable cutter. The improved impeller includes a plurality of blades each having a first substantially rectangular portion adjacent the rear end of the drum. The rectangular portions are substantially radially oriented within the interior of the drum. A second blade portion extends from the first portion of the blade toward the forward end of the drum. As the second portion extends toward the forward end of the drum, it also curves in the direction of movement of the blades. The curved portion of the impeller blades functions to scoop the vegetables gently as they enter the open end of the drum and guides them toward the closed end of the drum along the first rectangular portion of the impeller blades.

In a preferred embodiment, the interior portion of the drum coextensive in the forward direction with the rectangular portion of the impeller blade has a series of parallel grooves formed therein, the grooves being at oblique angles to a line located on the surface of the drum parallel to the longitudinal dimension of the drum. Also, the portion of the drum coextensive in the forward direction with the curved second portion of the impeller blade has a second series of grooves formed therein substantially parallel to one another and at a greater angle than the first series of grooves.

Also in a preferred embodiment, the potatoes are introduced into the drum in the lower quadrant of the open end of the drum below the slabbing knife so that the potatoes may travel from their point of entry around substantially the entire periphery of the drum prior to their contact with the knife. Thus, the potatoes have a maximum time to become properly oriented within the drum.

BRIEF DESCRIPTION OF THE DRAWINGS

The foregoing objects and advantages of the present invention will be better appreciated by those skilled in the art and others after reading the ensuing specification taken in conjunction with the attached drawings, wherein:

FIG. 6 is a front elevational view of a portion of the french fry cutter shown in FIG. 1;

FIG. 7 is a plan view of a flat impeller blade made in accordance with the principles of this invention prior to its being formed into its final shape;

FIG. 8 is a line generated by projecting the outer edge of a single impeller blade onto a cylinder housing the impeller, which cylinder is than flattened to provide a planar projection of the blade edge;

DETAILED DESCRIPTION OF THE PREFERRED EMBODIMENT

It should be understood by those skilled in the art and others that although the present invention is described herein in the environment of a french fry cutter, the improved impeller of this invention can be used in any vegetable cutting machine that utilizes a rotary impeller to bring the vegetables to the cutting knife on the periphery of a drum to improve the quality of the finished product and prevent bruising and fracturing of the vegetables introduced into the vegetable cutting apparatus.

Figure 1:
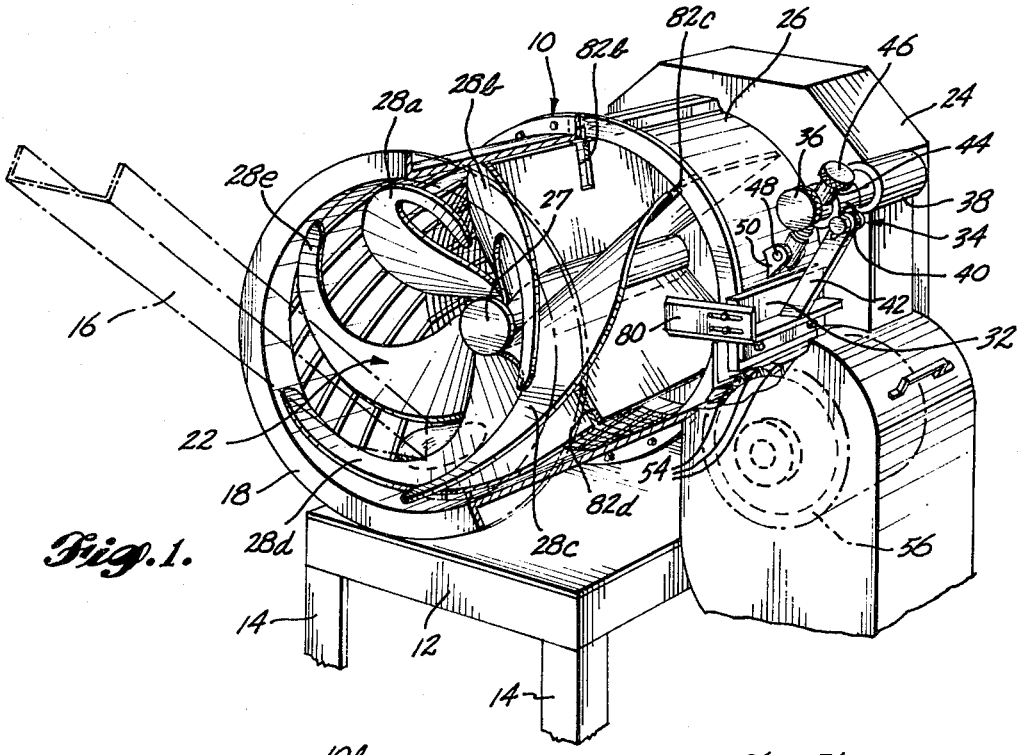
FIG. 1 is an isometric view with portions broken away of a french fry cutter having an impeller constructed in accordance with the principles of this invention installed therein.

Referring now to FIGS. 1 and 6, a french fry cutter comprises a hollow, substantially cylindrical drum 10 into which raw, peeled potatoes are introduced to be cut into french fry strips. The drum 10 is supported by a rectangular platform 12 which in turn is supported by legs 14 extending downwardly from the corners of the platform 12 and resting on the floor (not shown). A loading chute 16, shown in phantom outline in FIG. 1, is positioned adjacent a forward open end 18 of the drum. The chute 16 has its lower end adjacent the lower right quadrant of the open end of the drum and extends upwardly to a conveyor belt or distribution shaker (not shown) carrying the raw potatoes. The potatoes to be cut slide down the chute 16 and enter the drum 10 through the open end 18.

An impeller assembly 22 is mounted within the drum 10. The impeller assembly 22 is driven in a clockwise direction (as viewed in FIG. 1) by a drive means and gear train (not shown) housed in casing 24. Casing 24 is located adjacent a second, rear end 26 of the drum 10. The impeller comprises a central shaft 27 mounted along the longitudinal central axis of the drum 10, from which a plurality of circumferentially spaced curved blades 28*a* through 28*e* extend so that the edges of the blades sweep the interior surface of the drum 10 as the impeller rotates. The blades 28*a* through 28*e* of the rotating impeller assembly 22 engage the potatoes as they enter the forward end 18 of the drum 10 and carry the potatoes clockwise on the interior surface of the drum 10. The curvature of the impeller blades 28*a* through 28*e* (described in greater detail below) also causes the potatoes to be carried toward the rear of the drum 10 as they are urged around the interior circumference of the drum.

Figure 5:
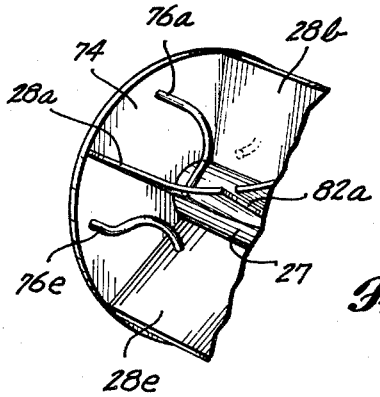
FIG. 5 is an isometric view of a portion of a second embodiment of an impeller made in accordance with the principles of the present invention.

As the potatoes move circumferentially along the interior surface of the drum 10, they come in contact with and are slabbed by the cutting edge of a slabbing knife 30 which is stationarily mounted in the wall of the drum 10 substantially parallel to the axis of rotation of the impeller assembly 22. The knife is located in the rear portion of the drum and extends from the rear end of the drum to a point approximately half-way between the rear end and forward end of the drum. The knife is oriented upwardly and inwardly and extends into the interior of the drum 10 through an elongate opening in the drum wall located approximately at the division between the upper right and lower right quadrants of the drum 10, as best seen in FIG. 5. The potato slab passes between the exterior side of the slabbing knife 30 and the interior surface of a slice guide plate 32 mounted adjacent the exterior of the drum 10 and exits the drum through the elongate separation in the drum wall. The impeller blades then carry the remainder of the potato through another circuit of the interior of the drum 10 until the potato again contacts the cutting edge of the slabbing knife 30 and another slab is cut off. This process continues until the entire potato has been slabbed.

A slab guide plate 32 is mounted in a position adjacent the exterior of the drum 10 by means of a slab width adjustment assembly 34. The slab width adjustment assembly includes a shaft 36 parallel to the axis of rotation of the impeller assembly and fixed within a cylindrical bushing 38 which in turn is affixed to the casing 24 above and to the right of slabbing knife 30. A ring collar 40 is tightened around the shaft 36 and an arm 42 is pivotally mounted at its upper end to the ring collar 40. The arm 42 extends from the collar 40 downwardly and toward the drum and has the slab guide plate 32 affixed to its lower end. The distance between the slab guide plate and the slabbing knife can be varied to accommodate different width slabs of potato by swinging the arm 42 either toward or away from the drum.

A threaded shaft 44 passes downwardly and toward the slabbing knife through the shaft 36 and has a knurled knob 46 fixedly attached to its upper end. The lower end of the threaded shaft abuts a stud 48 which is pivotally mounted in a tab 50 integrally formed on the exterior surface of the drum 10 in the upper right quadrant of the drum above the slabbing knife 30. A coil spring 52 surrounds the threaded shaft 44 along its extension between the stud 48 and the shaft 36. As the knurled knob 46 is turned, the threaded shaft 44 turns in or out of the shaft 36. As the threaded shaft 44 turns, it extends a greater or lesser amount from the shaft 36 and therefore exerts a greater or lesser force on the stud 48 and thence on the tab 50. The right upper quadrant of the drum 10 is hinged to the left upper quadrant of the drum. The right upper quadrant is therefore able to swing somewhat, thereby providing a variable radius of curvature of the interior surface of the drum immediately above the slabbing knife. The force on the tab 50 causes the wall of the drum 10 to move, thereby changing the radius of curvature of the interior of the drum in that portion of the drum adjacent and above the slabbing knife. Since the potatoes follow the interior surface of the drum as they approach the slabbing knife, the change in curvature directly changes the lateral position of the potato with respect to the cutting edge of the slabbing knife 30, thereby changing the slab width which is cut from the potato.

The slabs emerging from the drum 10 are cut into french fry strips by a series of crosscut knives 54 which are mounted on a cylindrical cutter reel 56 located below and to the right of the drum 10. The crosscut knives 54 are affixed to the outer periphery of the cutter reel 56 and are oriented so as to be orthogonal to the flat side of the potato slab at the point of intersection of the crosscut knife and the potato slab. The cutter reel 56 rotates in a counterclockwise direction opposite the direction of rotation of the impeller assembly 22. As the cutter reel 56 rotates, the crosscut knives 54 successively cut strips from the potato slab. The size of the strip cut depends on the time interval between successive crosscut knives passing the potato slab. The time interval can be changed either by varying the speed of rotation of the cutter reel 56 or by changing the number of crosscut knives mounted thereon.

Figure 2:
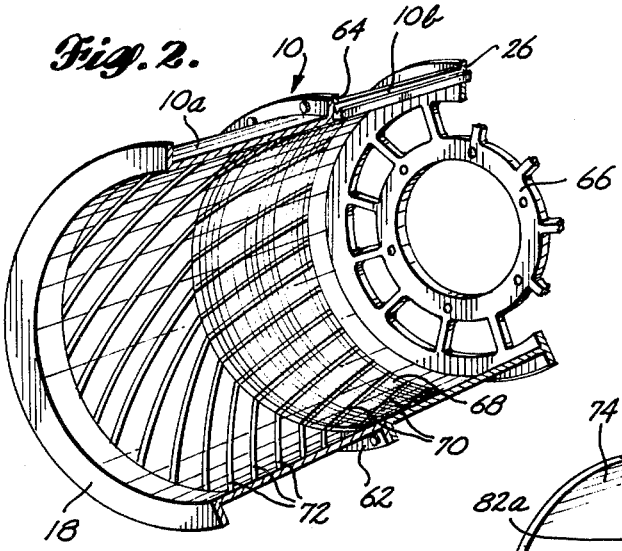
FIG. 2 is a cutaway view of the interior of the drum of the french fry cutter shown in FIG. 1.

Referring now to FIG. 2, the drum 10 comprises first and second adjoining cylindrical sections **10*a* and 10*b* respectively. The adjoining ends of the cylindrical sections 10*a* and 10*b* are butted together and secured by a series of bolts extending through flanges 62 and 64 which extend at right angles from the drum sections 10*a* and 10*b*, respectively, around the circumference of the drum. An annular, radially outwardly extending flange 66 is affixed across the second, rear end 26 of the drum. A series of closely spaced, parallel, circumferential grooves 68 are formed in the interior surface of the second section 10*b* of the drum 10. The circumferential grooves 68** help to hold the potato in position during its repeated circuits of the drum during the slabbing operation.

Preferably, another series of parallel grooves 70 is formed in the interior surface of the drum section **10*b*. The grooves 70 are more widely spaced than the grooves 68 and run generally longitudinally along the interior surface of the drum. The grooves 70 are at a small angle with respect to an imaginary line located on the interior surface of the drum parallel to the axis of the drum. The grooves 70 extend from the forward end of the drum section 10*b* where it adjoins the drum section 10*a* and extend toward the flange 66 and at the same time extend in the direction of rotation of the impeller assembly 22. Preferably, the angle between the imaginary line and a tangent to the groove 70 is 20°. Preferably, a third series of grooves 72 is formed on the interior surface of the first drum section 10*a*. The grooves 72 extend from a location near the open end 18 of the drum and extend toward the rear of the drum and at the same time in the direction of rotation of the impeller assembly 22. The grooves 72 terminate at the junction of the first and second drum sections 10*a* and 10*b*. The angle of the grooves 72 with respect to imaginary lines located on the interior surface of the drum parallel to the drum axis is greater than the angle of the grooves 70, the angle between a tangent to the grooves 72** and the imaginary line being preferably approximately 45°.

Most of the potatoes used in the french fry industry are in the shape of elliptical solids having a major axis and a shorter minor axis transverse to the major axis. It is desirable to produce french fries which are over 3" in length and therefore it is desirable to have the potatoes in the cutter aligned so that their major axis is parallel to the blade of the slabbing knife 30 so as to provide the longest french fry possible for a given potato. As the potatoes are urged toward the rear of the drum, they ride along the curved portion of the impeller blades **28*a* through 28*e*. The blades tend to orient the potatoes so that their major axis is parallel to the longitudinal extension of the blade. The grooves 70** tend to exert a drag on the potato as the potato travels along the interior surface of the drum and forces the potato to align itself along the blade in the above described desired orientation.

It is also desirable to minimize the force with which the impeller blades strike the potatoes as they enter the drum. The curve of the blades is such that as the potatoes enter the drum and the blades rotate, the faces of the blades curve away from the potato. Thus, when the potato and the blades do come into contact, the force of the impact is greatly reduced so that the potato is not bruised. The grooves 72 adjacent the forward end of the drum exert a drag on the potatoes as they move over the grooves and the potatoes tend to follow the grooves to reduce the drag, i.e., the potatoes follow the path of least resistance. The potatoes therefore move away from the advancing blades as they move toward the rear of the drum. The movement of the potatoes along a path following the grooves 72 thereby tends to minimize the force of impact between the potatoes and the impeller blades.

Figure 3:
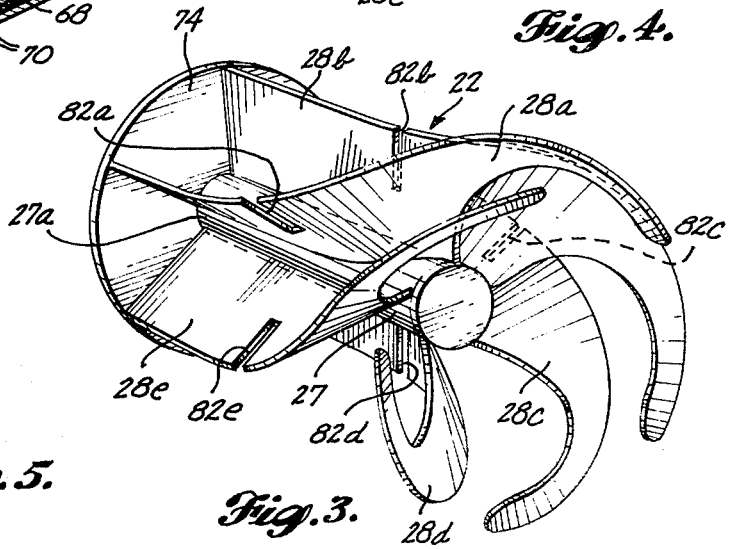
FIG. 3 is an isometric view of the improved impeller shown in FIG. 1.

Referring now to FIG. 3, the impeller assembly 22 includes a circular backing plate 74 affixed to the rear end **27*a* of the central shaft 27. The backing plate 74 is substantially orthogonal to the shaft 27 and the shaft 27 extends from substantially the center of the backing plate. The backing plate 74 is of a diameter such that it fits closely within the drum 10 but is free from the potato-contacting interior surface of the drum so that the impeller assembly 22 is free to turn within the drum 10**.

The impeller blades **28*a* through 28*e* radiate from the central shaft 27 and are equidistant from one another. Since the blades are identical, only the blade 28*a* will be described in detail as being representative of all of the impeller blades. The blade 28*a* has a first straight, rectangular portion adjacent the backing plate 74. The first portion has a first bottom side affixed to the central shaft 27 and a second adjacent side affixed to the backing plate 74. The second side extends from the surface of the shaft 27 to the outer edge of the backing plate 74 so as to allow the rectangular portion of the blade to sweep the interior surface of the drum 10 without binding on the drum. The rectangular portion of the blade extends from the backing plate forward a distance substantially equal to the length of the rear section 10*b* of the drum 10**.

The blade **28*a* has a curved second portion which extends forward from the first, rectangular portion and which also extends from the shaft 27 a distance equal to the first portion. As it extends forward, the second portion curves in the direction of rotation of the impeller assembly 22 (clockwise in the illustrated embodiment). The second portion extends forward to the free end of the central shaft 27 which is approximately halfway between the forward open end 18 of the drum and the junction of the first and second sections 10***a* and 10*b* of the drum.

The blade 28*a* extends forward from the second portion and narrows as it does so to form a third finger portion. The outer edge of the finger portion is always adjacent the interior surface of the drum 10. The inner edge curves away from the center of the drum to cause the finger portion to become narrower as it extends toward the open end 18 of the drum 10. The finger portion curves in the direction of rotation of the impeller assembly 22 as it extends forward toward the open end 18 of the drum 10. As the finger portion of the blade approaches the open end of the drum, the ratio between extension of the blade in the direction of rotation and extension in a forward direction increases until, at the open end of the drum, a terminal portion of the finger portion curves nearly circumferentially in the direction of rotation of the impeller assembly, with only a small forward extension toward the open end 18 of the drum 10.

When viewed along the longitudinal axis of the central shaft 27 and toward the backing plate 74, the blades 28*a* through 28*e* of the impeller assembly 22 overlap one another. The finger portions of the blades serve the scooping function as they contact the potatoes entering the open end 18 of the drum 18. The action of the impeller blades 28*a* through 28*e* as they scoop up the potatoes entering the drum 10 is akin to the action of the human hand as it scoops up a ball rolling on the ground. The speed of the potatoes as they enter the drum and the speed of rotation of the impeller assembly 22 can be adjusted so that the blades 28*a* through 28*e* do not contact the potatoes until the potatoes are well within the curved cupped section of the blade. The force of impact of the potato on the blade is thereby greatly reduced so as to eliminate bruising or fracturing of the potato upon impact with the blade. Once inside the cupped portion of the blade, the potato is swept around the interior circumference of the drum 10 and is held against the drum by centrifugal force. As the potato is swept circumferentially around the interior of the drum, it is also propelled toward the rear of the drum, the impeller assembly acting as somewhat of a rotary conveyor assisting the potatoes in their rearward travel in conjunction with the previously described grooves 70 and 72.

Figure 4:
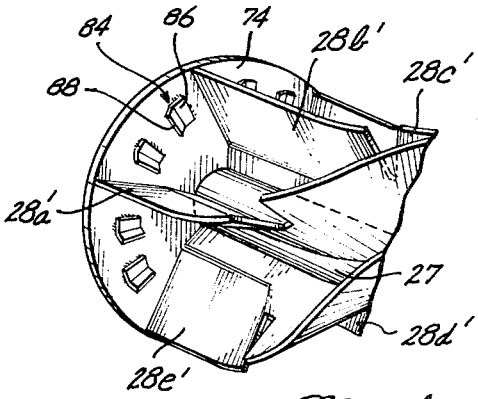
FIG. 4 is an isometric view of a portion of one embodiment of an impeller made in accordance with the principles of the present invention.

Referring now to FIG. 4, to eliminate any tendency the potatoes might have to stand on end on the surface of the impeller blade as they contact and bounce off the backing plate 74, preferably a series of catcher plates or baffles 84 can be installed on the backing plate 74 intermediate adjacent pairs of impeller blades. Each of the baffles 84 is identical and comprises a flat rectangular first plate 86 which is affixed to and is flat against the back plate 74. The long dimension of the plate 86 is oriented generally radially on the backplate. A second plate 88 of substantially the same dimensions as the first plate 86 is affixed to the first plate. The two plates 86 and 88 are joined along an edge such that the included angle between the plates is more than 90° but less than 180°. Therefore the second plate extends at an angle away from the backplate 74. Preferably two baffles 84 are mounted on the backplate intermediate each adjacent pair of impeller blades.

FIG. 4 also illustrates an alternative construction of the impeller blades. The impeller blades 28*a*′–28*e*′ have their respective first rectangular portions canted rearwardly in a direction opposite the direction of rotation of the impeller assembly. As in the previously described blades 28*a*–28*e* the first portion initially extends radially from the shaft 27. However, a relatively short distance from the shaft, rather than continuing the radial extension, the first portion of the blade extends along a plane canted away from the radial plane in a direction opposite the direction of rotation of the impeller assembly. Optimally the angle between the canted first portion and the plane oriented radially with respect to the shaft 27 is 14°. The cant of the blades enhances the sweeping effect of the blades as they pass over the interior surface of the rear drum section 10*b*. Also the cant of the blades substantially reduces any "bouncing" of the potatoes between the blades thereby aiding the prevention of bruising of the potatoes.

An alternate means of curtailing the bouncing of the potatoes off of the backplate 74 is illustrated in FIG. 5. Instead of the baffles 84 a series of bumper rods can be installed on the backing plate 74. A bumper rod 76*a* is affixed at its first end to the backing plate 74 intermediate the impeller blades 28*a* and 28*b*. The bumper rod 76*a* extends forward from the backing plate 74 and curves toward the potato contacting surface of the impeller blade 28*a*. The second end of the rod 76*a* is affixed to the impeller blade 28*a*. In a like manner, identical bumper rods can be installed intermediate each pair of adjacent impeller blades.

The blades 28*a* through 28*e* are preferably formed initially as flat planar blades and then curved prior to being installed on the shaft 27. A flat blade 28*a*″ prior to installation is illustrated in FIG. 7. The line 78 in FIG. 8 represents the radial projection of one of the curved impeller blades 28*a* through 28*e* onto the wall of a cylinder surrounding the blade. If the cylinder is then opened flat along its circumference, the projection of the blade would appear first as a straight line portion 78*a* representative of the rectangular first portion of the blade. Next, a central curved line 78*b* corresponds to the essentially spiral curvature of the curved second portion of the blade, and finally, a second straight line 78*c* extends from and is tangential to the curved line 78*b* and corresponds to the terminal portion of the finger portion which extends largely circumferentially within the drum with only a small forward extension.

In order to control the maximum length of the french fries produced and to provide for smooth, even cutting of the slabbing knife 30, the portion of any potato extending past the slabbing knife 30 is sliced off by a stationary knife 80 mounted at the forward end of the slabbing knife 30 extending radially inwardly into the interior of the drum 10. The cutting edge of the knife 80 is directed upwardly so as to slice off the excess length of any potato passing the slabbing knife 30. To prevent the stationary knife 80 from interfering with the impeller blades 28*a* through 28*e*, notches 82*a* through 82*e* can be formed in the outer edges of each of the impeller blades 28*a* through 28*e*, respectively, so that the knife 80 passes through the slots 82*a* through 82*e* as the impeller assembly 22 rotates.

Figure 9:
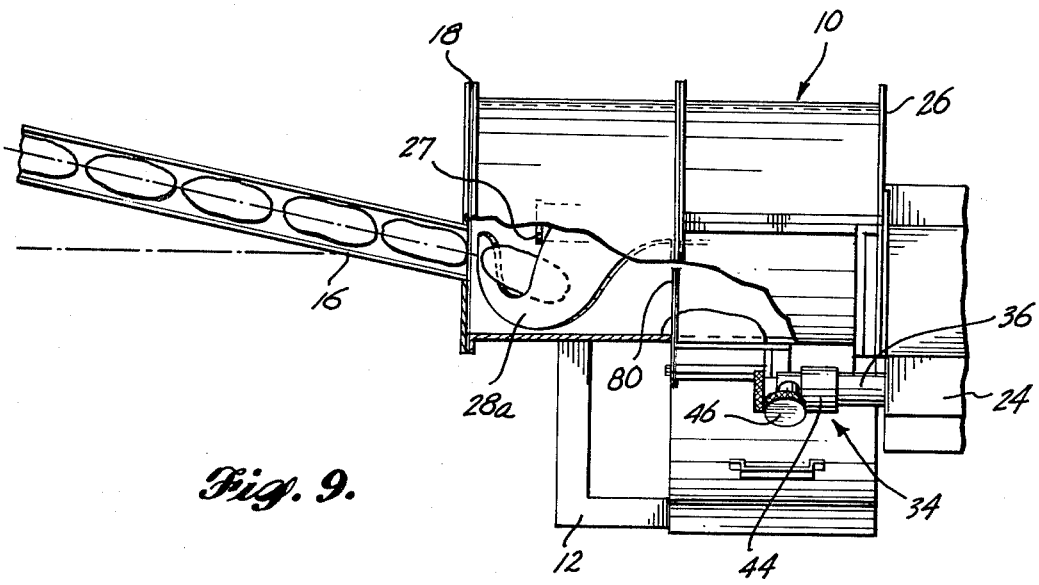
FIG. 9 is a plan view of the french fry cutter shown in FIG. 1 showing the potato feed chute to the cutter.
Figure 10:
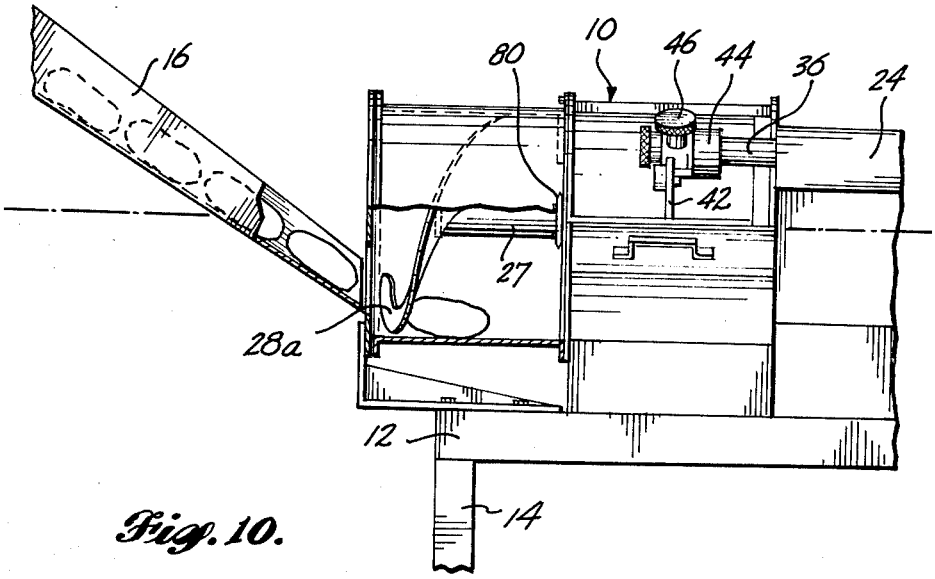
FIG. 10 is a side elevational view of the potato cutter of FIG. 1 showing the potato feed chute to the cutter.

As stated above, the speed of entry of the potatoes into the drum and the speed of rotation of the impeller assembly 22 can be coordinated to provide a minimum impact force between the potatoes and the impeller blades. The speed of the potatoes can be adjusted by varying the angle of the chute 16 which the potatoes slide down to enter the drum. For an impeller rotation of 135 rpm, it has been found that the optimum angle for the chute 16 is 30° above the horizontal and 20° to the left of a line parallel to the axis of rotation of the impeller assembly. The angles mentioned above are illustrated in FIGS. 9 and 10. The angles and rotational speeds mentioned are illustrative only. The improved impeller of this invention will give improved results and can be operated at other impeller speeds and potato entrance angles.

Keeping in mind that it is desirable in the french fry industry to produce french fries in which the majority of fries are over 3" long and to minimize the number of slivers and french fries under 2" long produced from a given batch of potatoes, a series of tests were run to determine the improvement in french fry product produced by use of the improved impeller assembly made in accordance with the principles of the present invention and described above. During the discussion of these test results, the size of the potatoes cut will be referred to as small, small to medium, and medium to large. By way of explanation, the term small when used in referring to a potato means that the long dimension of the potato (assuming potatoes which are generally in the shape of an elliptical solid) is from 2" to 4" and the dimension of the potato transverse to the long dimension is from 1¼" to 1¾". The term small to medium refers to potatoes in which the long dimension is from 3" to 5" and the transverse dimension is from 1½" to 2½". Finally, the term medium to large refers to potatoes in which the long dimension is from 5" to 11" and the transverse dimension is from 2" to 4".

In the tests run on the small potatoes, a series of four batches were run. Averaging the results of the four batches, the make-up of the final french fry product produced using the new impeller produced in accordance with the principles of this invention were as follows: 38.44% by weight of the final product was comprised of french fries that were over 3" in length. This represented a 49% increase over the french fries produced with the prior art impeller in which the over 3" french fries comprised only 25.76% of the final product. By the same token, french fries between 2" and 3" comprised 41.04% of the improved impeller product and 43.81% of the prior art impeller product. The under 2" french fries were reduced from 17.64% in the prior art impeller to only 12.75% in the new impeller. Finally, the amount of unusable slivers was reduced from 12.80% using the prior art impeller to only 7.77% using the improved impeller of this invention.

In another series of tests using medium to large potatoes, the over 3" french fries were increased from 74.85% of the final product when using the prior art impeller to 92.4% when using the new impeller. Also, the french fries between 2" and 3" were reduced from 15.5% to 2.88%. The under 2" french fries were reduced from 1.62% to 0.26% and the unusuable slivers were reduced from 8.04% to only 4.46% with the new impeller.

The comparison tests were run using an Urschel Laboratories french fry cutter, Model GRL and the impeller assembly was rotated at a speed of 135 rpm. It can be seen from the test results given above that the impeller blade made in accordance with the principles of this invention produces an improved product in that the percentage of longer french fries is greatly increased in the final product.

In summary, an improved impeller for use with a vegetable cutter has been disclosed. The impeller comprises a series of curved blades which radiate at equal intervals from a central shaft. The blades and shaft are affixed to a backing plate which is substantially orthogonal to the shaft. The entire impeller assembly rotates within a hollow cylindrical drum. The inside of the drum near the entrance end has a series of angled grooves formed therein to assist in propelling potatoes fed into the entrance end of the drum toward the rear of the drum. A second series of angled grooves is formed at a slightly lesser angle adjacent the backing plate of the impeller assembly to assist in aligning the potatoes so that their longer dimension is parallel to the axis of rotation of the impeller assembly.

A stationary knife is installed at a predetermined distance from the backing plate to cut off any excess length of potato over that desired. A slabbing knife is mounted adjacent the drum and extends into the interior of the drum. The slabbing knife slices off the potatoes as they are urged around the interior surface of the drum by the impeller blade. The curvature of the impeller blades is such that they act to scoop up the potatoes as they enter the drum and propel them rearwardly as a rotary conveyor. The curvature of the blades reduces the force of impact between the potatoes entering the drum and the impeller blades so as to prevent bruising and fracturing of the potatoes. Also, the configuration of the blades assists in aligning the potato with its long axis parallel to the axis of rotation of the impeller so that the longest possible french fries will be cut, thereby improving the end product from the french fry cutter.

As mentioned above, although the improved impeller made in accordance with the present invention was illustrated and described in conjunction with a french fry cutter, it is possible to use the improved impeller blade with any vegetable cutter in which vegetables are fed into a drum and urged around the drum by a rotary impeller, thereby forcing the vegetables against a knife mounted on the periphery of the drum so as to minimize the bruising of the vegetables as they are fed into the drum of the cutter and to assist in propelling the vegetables rearwardly and position them properly prior to contacting the cutting knives of the vegetable cutter. It will be appreciated by those skilled in the art and others that although a preferred embodiment of the invention has been described and illustrated, several changes can be made in the details of construction without affecting the spirit or scope of the invention as defined in the claims.

The embodiments of the invention in which an exclusive property or privilege is claimed are defined as follows:

1. In a vegetable cutter having a hollow, substantially cylindrical drum for receiving vegetables, said drum having a forward end through which the vegetables are introduced and a rear end, a slabbing knife mounted adjacent the periphery of said drum, substantially parallel to the axis of said drum, said knife extending into the interior of said drum and terminating in a cutting edge, and a plurality of impeller blades radially oriented with respect to said drum mounted within said drum for movement of the blades such that the blades sweep the interior surface of the drum so as to urge the vegetables against the cutting edge of the knife, the improvement wherein:

each of said impeller blades includes a first substantially rectangular portion adjacent said rear end of said drum, a second curved portion extending from said rectangular portion toward said forward end of said drum and as it extends toward the forward end of said drum, curving in the direction of movement of said impeller blades, and a third finger portion, said finger portion extending from the forward end of said second portion toward said forward end of said drum and also curving in the direction of movement of said impeller blades, the width of said finger portion in a direction radially oriented relative to the interior surface of said drum decreasing as it extends toward the forward end of said drum, said finger portion terminating adjacent the forward end of said drum, each of said blades having an outer edge that is substantially equidistant from the interior surface of said drum at each point along said outer edge.

2. In a vegetable cutter having a hollow, cylindrical drum for receiving vegetables, said drum having a forward end through which vegetables are received and a rear end, a slabbing knife mounted adjacent the periphery of said drum, said knife being substantially parallel to the axis of said drum and extending into the interior of said drum and terminating in a cutting edge, a plurality of radially oriented impeller blades mounted within the drum for movement of the blades such that the blades sweep the interior surface of the drum and urge the vegetables against the cutting edge of the knife, the improvement wherein each of said impeller blades curves in the direction of movement of the impeller blades as it extends from the rear of the drum to the forward end of the drum so as to form a curved portion in each of the impeller blades so that as a vegetable enters the drum and moves to the rear of the drum, the curvature of each of the blades is such that the blade curves away from the advancing vegetable, so as to minimize the force of impact between the vegetable and the blade when the vegetable and the blade come into contact.

3. The improvement of claim 1 or claim 2 wherein the interior surface of the drum has a series of grooves formed therein extending from the forward end of the drum toward the rear end of the drum and also extending in the direction of motion of the impeller blades at a predetermined angle and terminating at a predetermined distance from the rear end of the drum, the interior surface of the drum having a second series of grooves formed therein extending from the terminus of the first series of grooves to the rear end of the drum and also extending in the direction of movement of the impeller blade at a second predetermined angle, said second predetermined angle being less than said first predetermined angle.

4. The improvement of claim 3 further including:

an elongate shaft mounted within said drum parallel to the cylindrical axis of said drum, extending from adjacent the rear end of said drum toward said forward end of said drum, said impeller blades being radially oriented with respect to said shaft and said first portion of said blades extending from said shaft, and means for rotating said shaft about its elongate dimension.

5. The improvement of claim 4 further including: a backing plate affixed to an end of said shaft adjacent the rear end of said drum; and a plurality of bumper rods, each rod being orthogonal to and extending from said backing plate toward the forward end of said drum intermediate adjacent ones of said impeller blades, each said rod then curving toward and being affixed to a surface of one of said adjacent impeller blades.

6. The improvement of claim 4 further including: a backing plate affixed to an end of said shaft adjacent the rear end of said drum, and a plurality of baffles, at least one of said baffles being affixed to said backing plates intermediate adjacent ones of said impeller blades, each of said baffles including a first rectangular planar member affixed in planar contact to said backing plate and a second rectangular planar member affixed to said first rectangular planar member along a common edge such that the included angle between said planar members is greater than 90° and less than 180°.

7. The improvement of claim 6 wherein said included angle is 135°.

8. A rotatable impeller assembly for use with a vegetable cutter comprising:

a cylindrical shaft having a first and a second end;

a backing plate affixed to said first end of said shaft, substantially orthogonal thereto;

a plurality of impeller blades oriented radially with respect to said shaft equally spaced around said shaft, each of said impeller blades having a rectangular first portion extending from said shaft adjacent said first end of said shaft, a curved second portion extending from said first portion in a direction toward said second end of said shaft and curving around said shaft in the direction of rotation of the impeller assembly, and a third finger portion extending from said second portion toward the second end of said shaft and continuing to curve in said direction of rotation, the width of said finger portion in a direction radially oriented relative to said shaft decreasing as the blade extends toward said second end of said shaft.

9. The impeller assembly of claim 8 wherein said first rectangular portion is canted in a direction opposite the direction of rotation of said impeller assembly by a predetermined angle with respect to a plane including the axis of rotation of said impeller assembly.

10. The impeller assembly of claim 9 wherein said predetermined angle is 14°.

11. The impeller assembly of claim 8 further including a plurality of bumper rods, each of said rods having a first and a second end, the first end of each said rod being affixed to said backing plate intermediate adjacent ones of said impeller blades, said rod extending from said plate substantially orthogonal to said plate, then curving toward one of said adjacent impeller blades, the second end of each said rod being affixed to said one of said adjacent impeller blades.

12. An impeller assembly for use in a vegetable cutter, comprising:

shaft means for mounting said impeller assembly for rotation in a predetermined direction about an axis, a plurality of impeller blades mounted on said shaft means, the width dimension of said blades being oriented generally radially relative to said axis, each blade having a rearward rectangular portion affixed to and radiating from said shaft and having a curved forward portion affixed to and extending forwardly from said rearward portion, said forward portion curving about said axis in said predetermined direction as it extends forwardly, said forward portion being of lesser width than said rearward portion, each of said blades having an outer edge equidistant from said axis at all points along said edge.

13. The impeller assembly of claim 12 wherein said rearward rectangular portion is canted at a predetermined angle with respect to a plane containing the axis of rotation of said impeller assembly, said cant being in a direction opposite the direction of rotation of said impeller assembly.

14. The impeller assembly of claim 13 wherein said predetermined angle is 14°.

15. The impeller assembly of claim 12 further including a back plate affixed to the rearward portions of said blades and substantially orthogonal thereto.

16. The impeller assembly of claim 15 further including a plurality of bumper rods, each of said bumper rods having a first and second end, the first end of each rod being affixed to said back plate intermediate adjacent ones of said blades, said rod extending from said plate substantially orthogonal thereto, then curving toward one of said adjacent impeller blades, the second end of said rod being affixed to said one of said adjacent impeller blades.

17. The impeller assembly of claim 15 further including a plurality of baffles, at least one of said baffles being affixed to said back plate intermediate adjacent ones of said impeller blades, each of said baffles including a first planar member affixed in planar contact to said back plate and a second planer member affixed to said first planar member such that the included angle between said planar members is greater than 90° but less than 180°.

18. The impeller assembly of claim 12 wherein each blade further includes a third finger portion affixed to said forward portion, said finger portion extending forwardly from said forward portion and curving in said predetermined direction, the ratio between the curvature of said finger portion and the forward extension of said finger portion increasing as said finger portion extends from said forward portion.

19. The impeller assembly of claim 18 wherein said third portion of said blade in flat projection formed on a cylinder surrounding said impeller assembly, said cylinder then being rolled out flat, is tangential to a forward end of said forward portion of said blade.

* * * * *